US007918685B1

(12) United States Patent
Kruckenberg

(10) Patent No.: US 7,918,685 B1
(45) Date of Patent: Apr. 5, 2011

(54) CABLE ASSEMBLY FOR MOBILE MEDIA DEVICES

(75) Inventor: Michael Kruckenberg, Malden, MA (US)

(73) Assignee: CableJive LLC, Malden, MA (US)

( * ) Notice: Subject to any disclaimer, the term of this patent is extended or adjusted under 35 U.S.C. 154(b) by 0 days.

(21) Appl. No.: 12/752,506

(22) Filed: Apr. 1, 2010

(51) Int. Cl.
*H01R 13/648* (2006.01)

(52) U.S. Cl. ..... 439/502; 439/76.1; 439/607.45; 174/75 C; 174/78

(58) Field of Classification Search ..... 439/502, 439/76.1, 607.45, 607.41; 174/75 C, 78
See application file for complete search history.

(56) References Cited

U.S. PATENT DOCUMENTS

| | | | | |
|---|---|---|---|---|
| 4,558,918 | A | 12/1985 | Shores | |
| 5,372,517 | A | 12/1994 | Levesque | |
| 6,062,908 | A * | 5/2000 | Jones | 439/620.07 |
| 6,074,228 | A * | 6/2000 | Berg et al. | 439/180 |
| 6,790,094 | B1 * | 9/2004 | Bergmann et al. | 439/653 |
| 7,094,103 | B2 * | 8/2006 | Lai | 439/607.45 |
| 7,309,835 | B2 * | 12/2007 | Morrison et al. | 174/74 R |
| 7,342,172 | B1 | 3/2008 | Wang et al. | |
| 7,414,197 | B2 | 8/2008 | Ortiz et al. | |
| 7,462,073 | B2 * | 12/2008 | Bell et al. | 439/639 |
| 7,473,850 | B2 | 1/2009 | Glew | |
| 7,550,666 | B2 | 6/2009 | Burland et al. | |
| 7,564,678 | B2 | 7/2009 | Langberg et al. | |
| 7,587,540 | B2 | 9/2009 | Novotney et al. | |
| 7,621,780 | B2 | 11/2009 | Magnusson | |
| 7,625,239 | B1 | 12/2009 | Jatou et al. | |
| 7,625,243 | B2 | 12/2009 | Chen et al. | |
| 7,628,645 | B2 | 12/2009 | Baba et al. | |
| 7,632,147 | B2 | 12/2009 | Farahani et al. | |
| 7,634,605 | B2 | 12/2009 | Laefer et al. | |
| 7,647,129 | B1 | 1/2010 | Griffin, Jr. | |
| 2006/0116009 | A1 | 6/2006 | Langberg et al. | |
| 2006/0154530 | A1 | 7/2006 | Novotney et al. | |

(Continued)

OTHER PUBLICATIONS

Kruckenberg, M., "iPod Dock Extender", http://mike.kruckenberg.com/mt/mt-tb.cgi/980, Feb. 7, 2007.

*Primary Examiner* — Gary F. Paumen
(74) *Attorney, Agent, or Firm* — Rissman Hendricks & Oliverio LLP

(57) ABSTRACT

Disclosed herein is a mobile media device cable assembly for connecting a mobile media device with an accessory device, e.g., a docking station, audio system (stereo) or video system (television). The cable assembly provides multi-pin connections while the device is in a case or cover. The assembly comprises a flexible cable having a plurality of wires for transmitting audio, video, data, and power signals. The plurality of wires are in communication with respective pins of multi-pin female and male connectors on either terminus of the flexible cable. A first ground return comprising a flexible wire shield encapsulates the plurality of wires, and a second ground return comprising a flexible wire shield is surrounded by the first ground return. The second ground return encapsulates and electrically isolates the wires a subset of the plurality of wires, i.e., the wires that transmit audio and video signals, to prevent electric signal crossover. In one embodiment, at least two pins of each of the female and male connectors are electrically associated with the second ground return. In another embodiment, the multi-pin male connector comprises a first printed circuit board, where one end of the board is soldered to the plurality of wires and has a maximum dimension of 16 mm, and a housing associated with the multi-pin male connector has a maximum dimension of 27 mm.

17 Claims, 5 Drawing Sheets

U.S. PATENT DOCUMENTS

2006/0264114 A1* 11/2006 Novotney et al. ..... 439/660
2008/0144705 A1 6/2008 Rackin et al.
2009/0023336 A1 1/2009 Kondo et al.
2009/0069050 A1 3/2009 Jain et al.
2009/0069051 A1 3/2009 Jain et al.
2009/0104815 A1 4/2009 Reker
2009/0119721 A1 5/2009 Perlman et al.
2009/0197438 A1* 8/2009 Liu et al. ..... 439/76.1
2009/0215290 A1* 8/2009 Zhu et al. ..... 439/76.1
2009/0229850 A1 9/2009 Cases et al.
2009/0272571 A1 11/2009 Gromko et al.
2009/0292851 A1 11/2009 Mead et al.
2009/0295328 A1 12/2009 Griffin, Jr.
2009/0299506 A1 12/2009 Lydon et al.
2009/0303692 A1 12/2009 Terlizzi
2009/0307511 A1 12/2009 Fiennes et al.
2009/0325401 A1 12/2009 Sakairi et al.
2009/0325425 A1 12/2009 Ohshima et al.
2009/0327560 A1 12/2009 Yalovsky
2010/0258333 A1* 10/2010 Horan et al. ..... 174/78

* cited by examiner

CABLE ASSEMBLY FOR MOBILE MEDIA DEVICES

FIELD OF THE INVENTION

The present invention relates to a cable assembly for connecting mobile media devices with accessory devices.

BACKGROUND OF THE INVENTION

The market for mobile media devices, e.g., digital music players and smart phones, is filled with accessories to protect, enhance, and extend functionality of these devices. Such accessories include cases, microphones, speakers, car mounts and adapters. Certain accessory devices incorporate a docking station (or a "dock"), a form-fitting recess that connects the mobile device to an audio or video system (e.g., car, stereo, or television) via a multi-pin connector built into the bottom of the mobile device. The dock has a corresponding multi-pin connector that plugs into and "cradles" the mobile device, allowing the device to remain upright for visibility and accessibility. For example, car stereos incorporate docks on a dashboard or center console for a portable music player. A multi-pin connector in the dock provides a connection between the automobile and music player for connectivity of music, video, device control, charging, and other functionalities.

Individuals who purchase mobile media devices often decide to purchase a case to protect their investment. While the case shields the device from the elements, it can introduce difficulties in using the mobile device with docking stations. The case adds dimensions to the mobile device, rendering the device too large to fit into the docking station. As docking accessories can be very expensive, owners of these accessories often find themselves in a dilemma where they can only connect their music or phone device to a system via a docking station but the case makes it impossible to dock the device. As a result, the owner must continuously remove the case to plug the device into the dock.

Disclosed herein is a cable assembly for associating the mobile media device with an accessory device, such as a dock.

SUMMARY OF THE INVENTION

One embodiment provides a mobile media device cable assembly, comprising:

a multi-pin female and a multi-pin male connector joined by a flexible cable for associating the mobile media device with an accessory device, wherein the flexible cable comprises:

a plurality of wires for transmitting audio, video, data, and power signals, the plurality of wires being in communication with respective pins of the multi-pin female and male connectors;

a first ground return comprising a flexible wire shield encapsulating the plurality of wires; and a second ground return comprising a flexible wire shield surrounded by the first ground return, the second ground return encapsulating and electrically isolating the wires that transmit audio and video signals, to prevent electric signal crossover, and wherein at least two pins of each of the female and male connectors are electrically associated with the second ground return Another embodiment provides a mobile media device cable assembly, comprising:

a multi-pin female and a multi-pin male connector joined by a flexible cable for associating the mobile media device with an accessory device, wherein the flexible cable comprises a plurality of wires for transmitting audio, video, data, and power signals, the plurality of wires being in communication with respective pins of the multi-pin female and male connectors;

wherein each of the multi-pin female and male connectors is encapsulated by a housing;

wherein the multi-pin male connector comprises a first printed circuit board, one end of the board being soldered to the plurality of wires and having a maximum dimension of 16 mm; and wherein the housing of the multi-pin male connector has a maximum dimension of 27 mm.

BRIEF DESCRIPTION OF THE DRAWINGS

Various embodiments of the invention will be understood from the following description, the appended claims and the accompanying drawings, in which:

DETAILED DESCRIPTION

Figure 1:
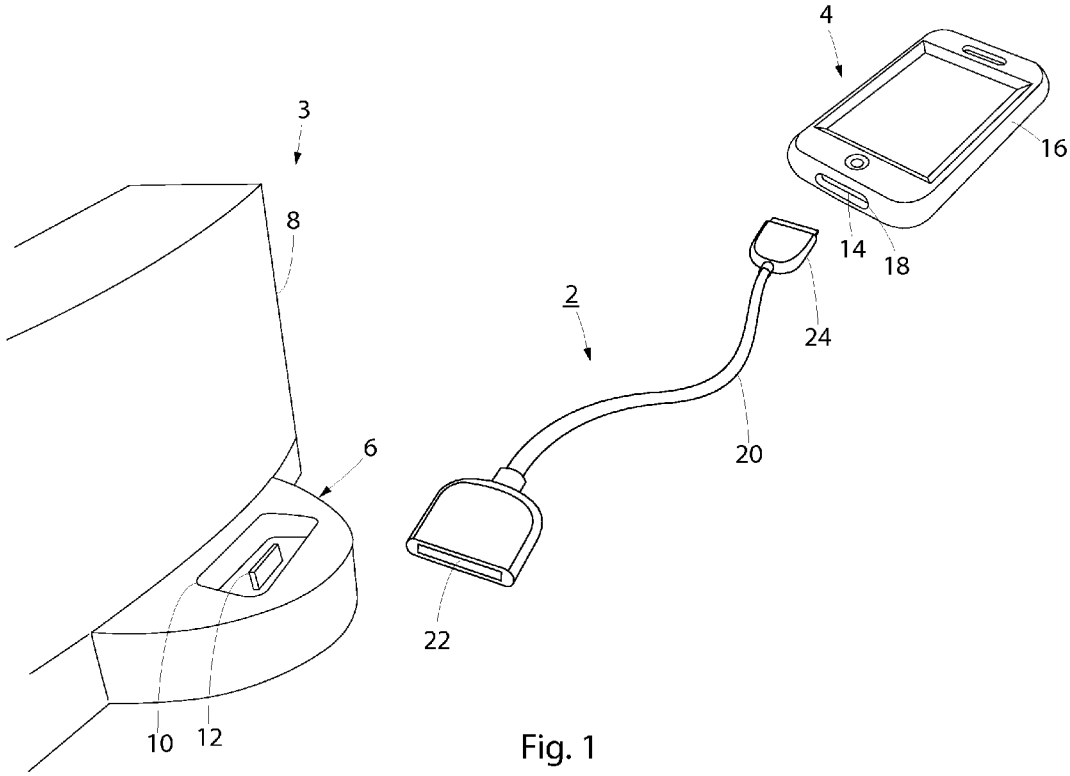
FIG. 1 illustrates a speaker system and a mobile media device in a case connected by one embodiment of a cable assembly.

FIG. 1 illustrates a mobile media device 4 connected to a docking station or dock 6 for an accessory device 8 (e.g., a speaker system), via one embodiment of a cable assembly 2, according to the present invention. The dock 6 is shown as built into the speaker system 8 but can alternatively be an independent unit external to the speaker system. The dock 6 has a recess 10 sized appropriately to cradle the portable media device 4, where the form factor of the recess 10 fits snugly around the device 4 to contain it in an upright position. At the bottom of the recess 10 is a male multi-pin connector 12 that provides a connection between a corresponding female multi-pin connector 14 of the portable media device. FIG. 1 further illustrates device 4 fitted in a case 16, where the additional dimensions afforded by the case result in an encased device 4 that no longer fits within recess 10, originally designed to form-fit device 4. Even if a docking station could be enlarged to provide an adequate recess size, the case 16 adds a thickness and separation that prevents a suitable electrical connection between male connector 12 of dock 6 and female connector 14 of device 4.

Currently there exists extenders or extension cables on the market that have a female connector for plugging into the dock, and a male connector for the device, where the first dock extender cable for an mp3 player with multi-pin connection came on the market in 2007 (invented and sold by the applicant). However, these dock extenders and extension cables have one or more inadequacies. First, these cables are limited in that they do not provide complete connectivity to fully engage the device with all the functionalities, e.g., audio, video, data, power. Moreover, their form factor is not ideal because of bulky, or ribbon-style cables, which are inflexible and not ideal for consumer use. None of these extenders or cables are built with housings sized such that they can fit into the connector openings of all cases. Finally, no existing products provide proper shielding for the specific signals traveling through a multi-pin cable to support all functions on these pins.

If a cable were constructed to convey all of the functionalities of the mobile media device by individually connecting each of the plurality of wires to a corresponding pin of the multi-pin connector, the resulting cable would be significantly thicker than cables typically associated with mobile devices. This thickness will necessarily increase for higher pin counts, e.g., 25 pin or higher (e.g., 30 pin) connectors. A thick and relatively inflexible cable is undesired, as the cable should permit sufficient mobility of the mobile media device while it is connected to and placed in close proximity to a docking station. A cable that does not retain sufficient flexibility will be incapable of coiling to the extent that a user must hold the mobile media device at an awkward angle when using the device with the cable attached. For example, one existing cable designed for connecting multi-pin functionality on mobile media devices measures 6 mm in thickness but does not transfer all of the functionalities of the mobile device. Adding the additional functionalities would only increase its thickness.

Electric signal crossover becomes an issue when multiple wires transmitting numerous electrical and electronic signals are placed in close proximity with each other. Each of these signals places different demands on the conductor passing the signals from one end to the other, where the individual wires in the cable assembly have varying characteristics to best meet the demands of the electric signals allocated to travel on that pin and wire in the cable. When electrical signals travel through separate wires placed in close proximity, the electric signal from one wire can influence the signal traveling through an adjacent wire, an event known as interference or crosstalk. For example, wires that carry signals for audio, video, and device control have less demand current requirements and can pass through signals on smaller gauge wire. These smaller wires, however, have less protective insulation. A multi-conductor cable that has a higher current charging signal wire positioned next to a low-current audio or video wire will manifest this interference in the low-current audio or video signal being distorted, interrupted, or degraded. The interference on audio or video signals makes the experience of listening to audio or watching video sub-par and is more noticeable to the listener or viewer than interference on a wire that doesn't have audible or visual manifestations.

Accordingly, one embodiment provides a mobile media device cable assembly, comprising:

a multi-pin female and a multi-pin male connector joined by a flexible cable for associating the mobile media device with an accessory device, wherein the flexible cable comprises:

a plurality of wires for transmitting audio, video, data, and power signals, the plurality of wires being in communication with respective pins of the multi-pin female and male connectors;

a first ground return comprising a flexible wire shield encapsulating the plurality of wires; and a second ground return comprising a flexible wire shield surrounded by the first ground return, the second ground return encapsulating and electrically isolating the wires that transmit audio and video signals, to prevent electric signal crossover, and wherein at least two pins of each of the female and male connectors are electrically associated with the second ground return.

In one embodiment, the cable assembly is designed to connect the mobile device to multi-pin connectors on various accessory devices (e.g., docking stations, stereos (home and auto), televisions, computers, etc.) while retaining all the functionality of the mobile device, e.g. audio, video, data (e.g., USB, serial binary control signals), and power (charging). In another embodiment, the cable assembly is designed to connect the mobile device to a dock, which can be a standalone unit that connects the mobile device with another accessory device, or can be built into the accessory device. In yet another embodiment, the cable assembly is designed to connect the mobile device with another cable associated with an accessory device.

In one embodiment, a thin and flexible cable assembly allows user-friendly motion when holding and moving the device, as flexibility is improved when the cable thickness is reduced. Accordingly, the cable assembly features a thin and flexible cable that also permits the device to transfer all of its functionality to an external system, e.g., a docking station. In one embodiment, the cable assembly replaces multiple ground return wires with wire shields (e.g., stranded wire) that run the length of the cable and encapsulate all or a subset of the plurality of wires. In one embodiment, the wire shield can be braided. In one embodiment, the wire shields themselves are further surrounded by a flexible housing, which can be made from a very thin rubber, plastic (polymeric), or a composite film (e.g., a thermoplastic elastomer or polyvinyl chloride), and do not add significant thickness to the cable.

In one embodiment, the cable assembly carries all functionality from the docking station to the mobile device while eliminating the crossover among different functionalities by the use of the flexible wire shields. The multi-pin connector and multi-wire cable assembly are typically utilized to transmit a variety of signal types, including audio, video, data (e.g., USB, serial control), and power.

In one embodiment, a first ground return comprises a flexible wire shield that encapsulates the plurality of wires. A second ground return comprising a second flexible wire shield is contained within and surrounded by the first ground return, where the second ground return encapsulates a subset of the plurality of wires, e.g., a group of wires having similar functionality such as the wires that transmit audio and video signals. Both wire shields spans the length of the cable. This arrangement results in a thinner cable and provides the additional benefit of electrically isolating the wires having a similar gauge and/or functionality, thereby preventing electrical signal crossover. In another embodiment, the shield allows the use of even thinner wire gauges, thereby decreasing the overall diameter/thickness of the cable.

Figure 2:
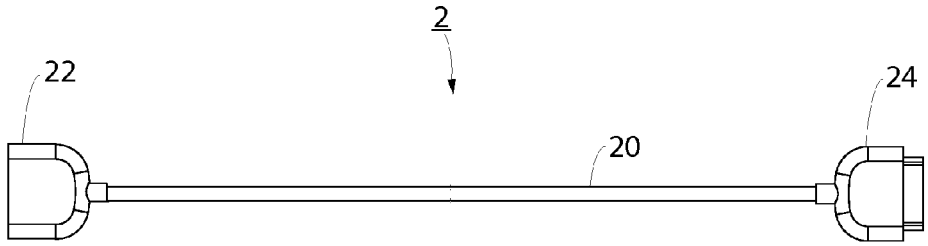
FIG. 2 is a top plan view of the cable assembly of FIG. 1, featuring a cable joining male and female multi-pin connectors.

As illustrated in FIGS. 1 and 2, cable assembly 2 comprises at one terminus a multi-pin female connector 22 in electrical communication with a male connector 24 via cable 20. Cable 20 contains a plurality of wires (see, e.g., FIGS. 7 and 8) that transmit signals for audio, video, data, power (charging), and so forth. By fitting female connector 22 with male connector 12 of the dock 6, and male connector 24 with female connector 14 of the device 4, a connection is achieved between the device 4 and dock 6 (and ultimately speaker 8) that transfers all of the functionality of the device 4 while keeping device 4 within its case 16. This can be advantageous when a user prefers to keep the device 4 protected at all times. Moreover, if the dock is associated with a stereo system in a car, a driver can easily connect a portable media device with the car stereo without removing the case. The cable assembly is equally useful for connecting mobile media devices with accessory devices that do not incorporate a dock but have a cable containing the multi-pin male connector.

Figure 7:
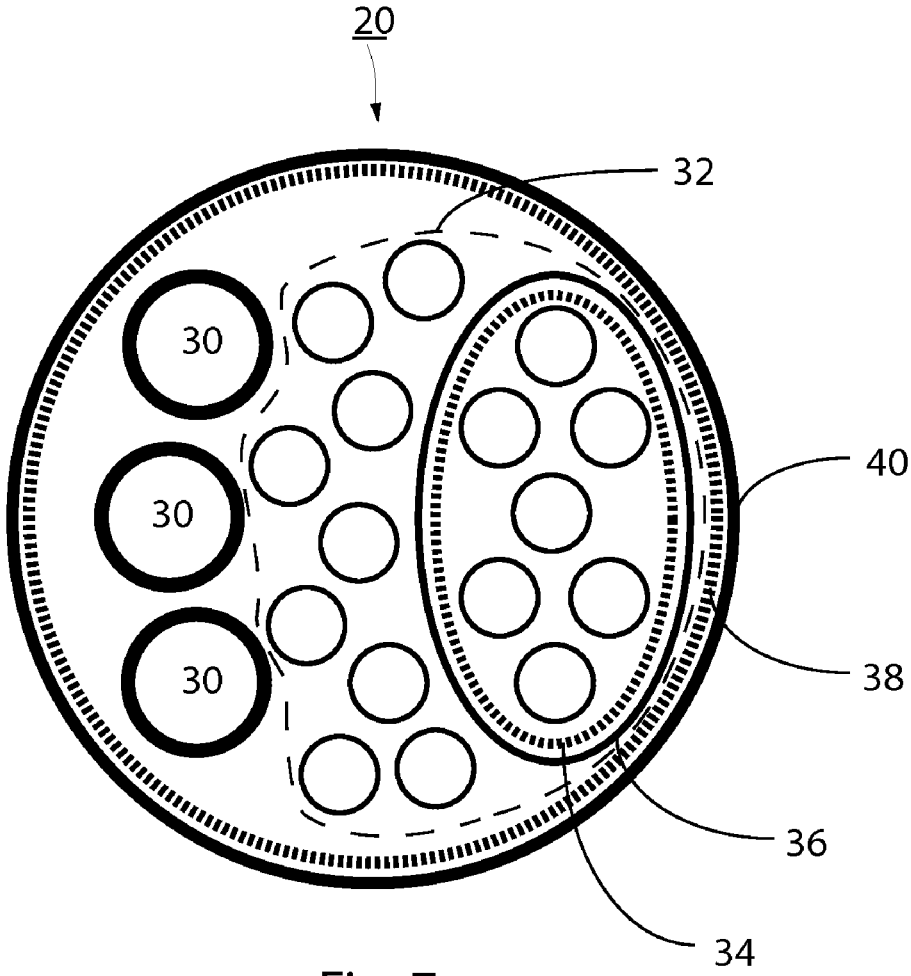
FIG. 7 is a cross-section of the cable of FIG. 2, featuring a plurality of individual wires, a subset of the wires being encapsulated in a wire shield.

FIG. 7 is a cross-section of cable 20 according to the one embodiment of FIG. 2. Wires 30 that connect pins used for charging carry a higher current are transmitted on a heavier gauge to properly preserve functionality between the docking station and the mobile media device. These heavier gauge wires also have more protective insulation to contain heat generated by the higher flow of electrical current. Wires that carry signals for audio, video, and device control (e.g., wires contained within dotted line 32) have a lower current requirement and can pass through signals on smaller gauge wire. These smaller wires, however, have less protective insulation.

To combat the effect that electric signals have on each other, an extra layer of shielding is provided around a subset of the plurality of wires (e.g., wires within shield 34) designated for low-current audio and video electrical signals. A wire shield 34 encapsulates these wires and prevents any electric signal crossover from other wires in the cable assembly into the audio and video wires and their signals. Further encapsulating wire shield 34 is a plastic housing 36 to contain the group. A wire shield 38 is also provided around the plurality of wires of the entire cable, wire shield 38 in turn being encapsulated within plastic housing 40 (e.g., a thermoplastic elastomer or polyvinyl chloride). The two wire shields 34 and 38 are used as ground returns and connect to at least two pins of each of the multi-pin male and female connectors, thereby replacing multiple ground return wires and reducing the overall thickness of the cable. Shield 38 can be used to return the ground for the more powerful signals for charging, where shield 34 carries the ground return for the audio signal.

FIG. 7 illustrates an arrangement where the wires grouped together within shield 34 are those that transmit audio and video signals only. No other wire types are included in this group to ensure that there will be minimal, if any, interference with audio/video signals of the grouped wires. The additional plastic housing and shield do not increase the cable diameter/thickness significantly, nor do they have a fundamental effect on the flexibility of the cable.

In one embodiment, the multi-pin male and female connectors contain at least 25-pins, e.g., at least 30 pins. In one embodiment, the multi-pin male and female connectors are 30-pin connectors. In one embodiment, a 30-pin connector cable assembly is provided with a maximum cable thickness of 6 mm, or a maximum thickness of 5 mm (e.g., a thickness of 4.5 mm), or even a maximum thickness of 4 mm. At these thicknesses, the constructed cable offered significantly improved flexibility over prior art multi-pin cables, giving the user a wider range of motion and the ability to use the mobile media device comfortably at any angle desired.

Figure 8:
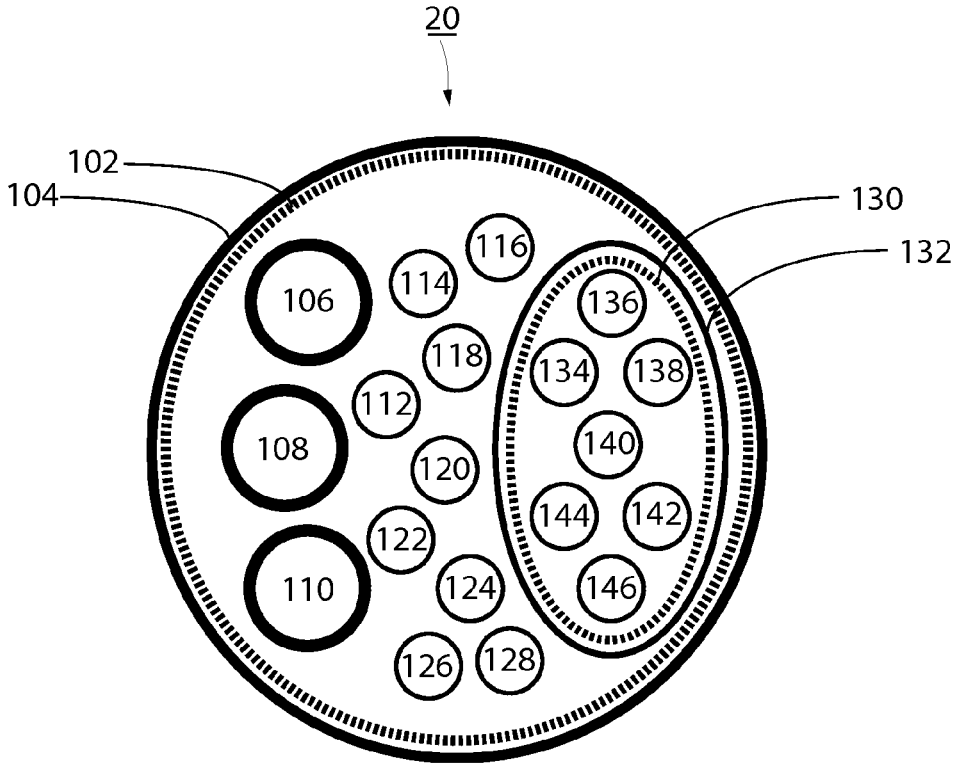
FIG. 8 is a cross-section of one embodiment of a cable of FIG. 7, featuring the functionalities of each individual wire and wire shield.

A more specific example of the cable construction and functionality of FIG. 7 is illustrated in FIG. 8, which shows a cross-section of a cable 100 that connects 30-pin male and female connectors. Shield 102 encapsulates all of the wires and is used as the primary ground return for the multi-pin connectors, and is further surrounded by a plastic housing 104. Shield 102 replaces two ground return wires. Wires 106 and 108 are heavier gauge wires used for conducting larger currents of Universal Serial Bus (USB) power, where wire 106 can used for the positive USB current flowing to the device and wire 108 can be used for the USB ground return. The heavier gage wire 110 can used for 3.3V power flowing from the device back to the docking station or accessory. Wires 112, 114, 116, and 118 can be used for communication between the docking station or and the device, allowing a serial connection to be established and then commands for controlling the device be passed from the dock station to the device and feedback being passed back from the device to the dock station. Wire 120 can be used for device identification, passing signals to identify the version of the device. Wires 122 and 124 are parallel conductors for 12-volt power flowing to the device using the IEEE 1394 High Speed Serial Bus (FireWire) protocol. Wires 126 and 128 can be used to conduct USB data transfer signals. Shield 130 encapsulates all audio and video signal wires traveling through the cable assembly and is in itself surrounded by a plastic housing 132. Shield 130 also provides the ground return for audio and video signals. Wires 134 and 136 can be used for right and left audio output signals from the device that travel through the wire to bring audio signal to the speakers or other docking station audio output. Wires 138 and 140 can be used for bringing right and left audio signals into the device from an external microphone or other audio output source. These audio input wires can be used for functions such as recording or voice recognition on the mobile media device. Video signals can travel out of the device on wires 142, 144, and 146. These wires can be used in varying configurations to transmit a composite video signal, separate video signals (S-video) or component video signals.

Recently, a number of hardshell cases have been marketed for mobile media devices that afford only a very small opening to a built-in multi-pin connector. The housing that encapsulates the male and female connectors in commercially available cables is too large to allow the male and female connectors to properly engage with the mobile media device fitted within these rigid cases. Indeed, these prior art housings measure approximately 28 mm, which is too wide for the rigid case openings. In addition to the extra width, existing housings are often not shaped to allow insertion into a mobile media device case opening. FIG. 1 shows an example of a mobile media device 4 inside a case 16 having an opening 18 that exposes female connector 14. This opening is minimal, designed to expose as little of the connector 14 as possible. Moreover, for some cases, the opening has a rectangular shape with rounded corners, resulting in only a few millimeters of space surrounding the female multi-pin connector receptacle. Even if some of the housing material could be eliminated, existing cable extenders have a rectangular shape with 90 degree corners shaped that preclude insertion into the case opening.

In one embodiment, these smaller housings around the connectors are achieved with a small printed circuit board (PCB) having one end in electrical and/or electronic communication with the plurality of wires. Accordingly, one embodiment provides a mobile media device cable assembly, comprising:

a multi-pin female and a multi-pin male connector joined by a flexible cable for associating the mobile media device with an accessory device, wherein the flexible cable comprises a plurality of wires for transmitting audio, video, data, and power signals, the plurality of wires being in communication with respective pins of the multi-pin female and male connectors;

wherein each of the multi-pin female and male connectors is encapsulated by a housing;

wherein the multi-pin male connector comprises a first printed circuit board, one end of the board being soldered to the plurality of wires and having a maximum dimension of 16 mm; and wherein the housing of the multi-pin male connector has a maximum dimension of 27 mm.

The maximum dimension of 27 mm of the housing spans the maximum dimension of the one end of the printed circuit board. This maximum dimension allows the multi-pin male connector to penetrate the opening of a rigid case that exposes the built-in female connector.

In one embodiment, an orthogonal side of the first printed circuit board has a maximum dimension of 6 mm.

In one embodiment, the multi-pin female connector comprises a second printed circuit board, one end of the board being soldered to the plurality of wires and having a maximum dimension of 24 mm. In another embodiment, an orthogonal side of the second printed circuit board has a maximum dimension of 12 mm.

Figure 3:
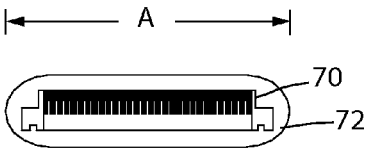
FIG. 3 is a plan view of a terminus of the multi-pin male connector of FIG. 2.
Figure 4:
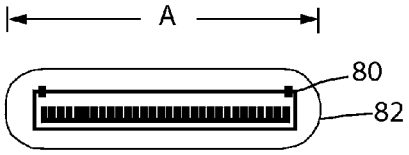
FIG. 4 is a plan view of a terminus of the multi-pin female connector of FIG. 2.
Figure 5:
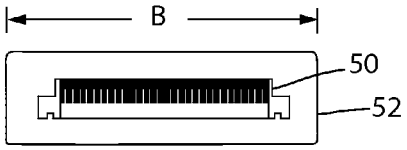
Fig. 5 (prior art)
FIG. 5 is a plan view of a terminus of a prior art multi-pin male connector.
Figure 6:
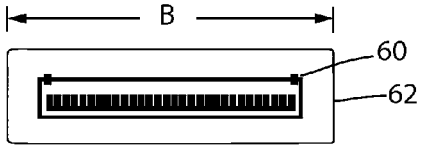
Fig. 6 (prior art)
FIG. 6 is a plan view of a terminus of a prior art multi-pin female connector.

FIGS. 5 and 6 are plan views of the ends of a prior art multi-pin male connector 50 within housing 52, and a prior art multi-pin female connector 60 within housing 62, respectively. In comparison, FIGS. 3 and 4 show an embodiment of the housing that adds minimally to the size of the connector, featuring plan views of the ends of a multi-pin male connector 70 within housing 72, and a multi-pin female connector 80 within housing 82, respectively. In one embodiment, the housing of FIG. 3 has a maximum dimension of 27 mm, as indicated by arrow A. In contrast, both prior art housings 52 and 62 are examples of larger housings having a maximum dimension (arrows B) of approximately 28 mm at best. The housing of FIG. 4 for the female connector has a maximum dimension of 29 mm, as indicated by arrow A. It is noted that the female connector connects to the dock or accessory device and does not need to pass through a rigid case opening.

In another embodiment, the housing of FIGS. 3 and 4 have an approximate rectangular shape with rounded corners (or rounded edges) to eliminate even more material from the housing. In contrast, the prior art housings of FIGS. 5 and 6 have sub-optimal shapes as they feature approximately L-shaped corners, which adds additional housing material. The rounded ends keep the housing profile close to the connector, allowing the housings 72 and 82 to be inserted through very small openings of certain commercially available mobile media device case, e.g., case of rigid plastic that offer no flexibility in the opening for the multi-pin connector.

This circuit board provides a sturdy surface to mount the female and male connectors on their respective ends, and also provides a surface area larger than the pins on the connector itself to attach the individual wires that run through the cable housing. The embodiment of the cable assembly 2 shown in FIG. 2 has a female connector 22 with an internal PCB of substantially rectangular shape. One end of the board is soldered to the plurality of wires contained within the adjoining cable 20 where the one end has a maximum dimension of 24 mm. In one embodiment, the PCB for the female connector measures 24 mm×12 mm. The male connector 24 also contains a PCB of substantially rectangular shape, where one end of the board that is soldered to the plurality of wires has a maximum dimension of 16 mm. In one embodiment, the PCB of the male connector measures 16 mm×6 mm. The PCB allows all functionality to be connected, but is of a sufficiently small size to fit inside the connector housing without adding extra height or width to the housing. In one embodiment, a maximum dimension of the PCB is 27 mm, where this maximum dimension spans the width of the one end of the PCB board for the male connector. In another embodiment, the maximum dimension is 26.5 mm, or 26 mm.

The cable assembly described herein allows the device to plug into the external system while conveying all the functionality to fully engage the mobile device. This can be advantageous in allowing the mobile device to remain within its case while connecting to an accessory device. Additionally, the cable assembly is designed to fit across a wider range of housings and to have a slim, more flexible form factor for better consumer use.

The invention claimed is:

1. A mobile media device cable assembly, comprising:

a multi-pin female and a multi-pin male connector joined by a flexible cable for associating the mobile media device with an accessory device, wherein the flexible cable comprises:

a plurality of wires for transmitting audio, video, data, and power signals, the plurality of wires being in communication with respective pins of the multi-pin female and male connectors;

a first ground return comprising a flexible wire shield encapsulating the plurality of wires; and a second ground return comprising a flexible wire shield surrounded by the first ground return, the second ground return encapsulating and electrically isolating the wires that transmit audio and video signals, to prevent electric signal crossover, and wherein at least two pins of each of the female and male connectors are electrically associated with the second ground return.

2. The cable assembly of claim 1, wherein each of the multi-pin female and male connectors contain at least 25 pins.

3. The cable assembly of claim 1, wherein each of the multi-pin female and male connectors are 30-pin connectors.

4. The cable assembly of claim 1, wherein a thickness of the cable is 6 mm or less.

5. The cable assembly of claim 1, wherein a thickness of the cable is 5 mm or less.

6. The cable assembly of claim 1, wherein at least two pins of each of the female and male connectors are electrically associated with the first ground return.

7. The cable assembly of claim 1, wherein the wire shield of the second ground return is braided.

8. The cable assembly of claim 1, wherein a flexible housing surrounds each wire shield.

9. The cable assembly of claim 1, wherein:

the multi-pin male connector comprises a first printed circuit board, one end of the board being soldered to the plurality of wires and having a maximum dimension of 16 mm; and the multi-pin male connector has a housing with a maximum dimension of 27 mm.

10. The cable assembly of claim 9, wherein the multi-pin female connector comprises a second printed circuit board, one end of the board being soldered to the plurality of wires and having a maximum dimension of 24 mm.

11. A mobile media device cable assembly, comprising:

a multi-pin female and a multi-pin male connector joined by a flexible cable for associating the mobile media device with an accessory device, wherein the flexible cable comprises a plurality of wires for transmitting audio, video, data, and power signals, the plurality of wires being in communication with respective pins of the multi-pin female and male connectors;

wherein each of the multi-pin female and male connectors is encapsulated by a housing;

wherein the multi-pin male connector comprises a first printed circuit board, one end of the board being soldered to the plurality of wires and having a maximum dimension of 16 mm; and wherein the housing of the multi-pin male connector has a maximum dimension of 27 mm.

12. The cable assembly of claim 11, wherein the first printed circuit board has an orthogonal side with a maximum dimension of 6 mm.

13. The cable assembly of claim 11, wherein the multi-pin female connector comprises a second printed circuit board, one end of the board being soldered to the plurality of wires and having a maximum dimension of 24 mm.

14. The cable assembly of claim 13, wherein the second printed circuit board has an orthogonal side with a maximum dimension of 12 mm.

15. The cable assembly of claim 11, wherein each of the multi-pin female and male connectors contain at least 25 pins.

16. The cable assembly of claim 11, wherein each of the multi-pin female and male connectors are 30-pin connectors.

17. The cable assembly of claim 11, wherein the housings for each of the multi-pin female and male connectors have a rectangular shape with rounded corners or rounded edges.

* * * * *